United States Patent [19]

Hasenpath et al.

[11] 4,160,303

[45] Jul. 10, 1979

[54] MECHANICAL SWEEPERS

[76] Inventors: Helmut Hasenpath, Kolberg-Körlin-Str. 86, D-2060 Bad Oldesloe; Hargen Rohde, Paul V. Schoenaich-Str. 1, D 2067 Reinfeld, both of Fed. Rep. of Germany

[21] Appl. No.: 728,265

[22] Filed: Sep. 30, 1976

[30] Foreign Application Priority Data

Sep. 5, 1975 [DE] Fed. Rep. of Germany ..... 2539496

[51] Int. Cl.[2] ..... D47L 9/10; B60P 1/34; E01H 1/04

[52] U.S. Cl. ..... 15/349; 414/406

[58] Field of Search ..... 15/349, 352, 340, 347; 55/428, 429; 214/302

[56] References Cited

U.S. PATENT DOCUMENTS

| | | | |
|---|---|---|---|
| 793,700 | 7/1905 | Whittmore | 214/148 |
| 1,920,243 | 8/1933 | Casper | 214/302 |
| 3,304,572 | 2/1967 | Wendel | 15/352 X |
| 3,342,358 | 9/1967 | French et al. | 214/302 |
| 3,452,891 | 7/1969 | Wilson et al. | 214/302 X |
| 3,744,653 | 7/1973 | Jensen | 15/340 X |
| 3,765,554 | 10/1973 | Morrison | 214/149 G X |

*Primary Examiner*—Christopher K. Moore

[57] ABSTRACT

The specification discloses a mechanical sweeper having a roller brush which throws rubbish forward in the direction of travel into a collecting hopper. The hopper is mounted in a fork carried by a lifting arm and the arrangement is such that actuation of the lifting arm does not cause tipping of the hopper. Separate means are provided for tipping the hopper at any desired moment during lifting.

6 Claims, 4 Drawing Figures

MECHANICAL SWEEPERS

BACKGROUND OF THE INVENTION

1. Field of the Invention

The invention relates to a mechanical sweeper having a roller brush which throws rubbish forward in the direction of travel into a collecting hopper which is connected via a filter to a suction fan. Such sweepers may be driven or have control arms.

2. Description of the Prior Art

In suction-assisted mechanical sweepers as mentioned above which have rubbish collecting hoppers mounted at the front, it is known to lift the rubbish hopper up slightly out of the sweeper once it is full, whereupon the hopper, which is mounted in a fork, immediately tips on pins on the arms of the fork so that its contents are emptied onto the ground, from where they have to be removed by other means.

The object of the invention is to make it possible, in mechanical sweepers of this kind, rubbish hoppers having a brush adapted for throwing rubbish forwardly in the direction of travel into a collecting rubbish hopper and adapted for the rubbish hopper to be lifted out of the sweeper to any desired height, and to be emptied into a rubbish skip or some other receptacle, only when it has reached the required height.

SUMMARY OF THE INVENTION

In accordance with the invention, this object is achieved, in the suction-assisted mechanical sweeper described at the beginning, by mounting the rubbish hopper in a fork on a lifting arm and mounting the lifting arm at the upper end of a support frame fixed to the sweeper in such a way that the arm can be pivoted upwards while the rubbish hopper is maintained in a position parallel to the ground, and by making the rubbish hopper capable of being tipped to empty it when the lifting arm is in any pivoted position. In this way it becomes possible for sweeping, the picking up of rubbish, forward travel, and the emptying of the rubbish hopper into a larger receptacle e.g. a rubbish skip, to take place in one continuous operation.

An advantageous procedure which is adopted in accordance with the invention for the above purpose is for the lifting arm to pivot on a shaft at the top of the support frame and to engage with a chain or cable or the like which passes round the upper, rounded end of the lifting arm, which chain or cable co-operates with an actuator for drawing it in or letting it out, and to mount on the pivot shaft for the lifting arm, a sprocket which is freely rotatable on the shaft, which can be turned and held stationary by an actuator, and around which a chain passes. The latter chain is coupled via intermediate sprockets to chains in the arms of the fork and in the end of each of these arms there is a sprocket which is free to rotate on a stub-shaft from the rubbish hopper and which is rigidly connected to a lever the end of which cooperates with a pin fastened to the hopper.

This arrangement ensures that when the lifting arm is pivoted, the rubbish hopper is maintained in a position parallel to the ground and that not until it reaches a desired height, i.e. one above a rubbish skip, is the hopper tilted by the actuator which operates the chains in the fork of the lifting arm to empty it.

BRIEF DESCRIPTION OF THE DRAWINGS

Other objects and advantages will become apparent from the following description of one embodiment of the invention with reference to the appended drawings, in which.

Figure 1:
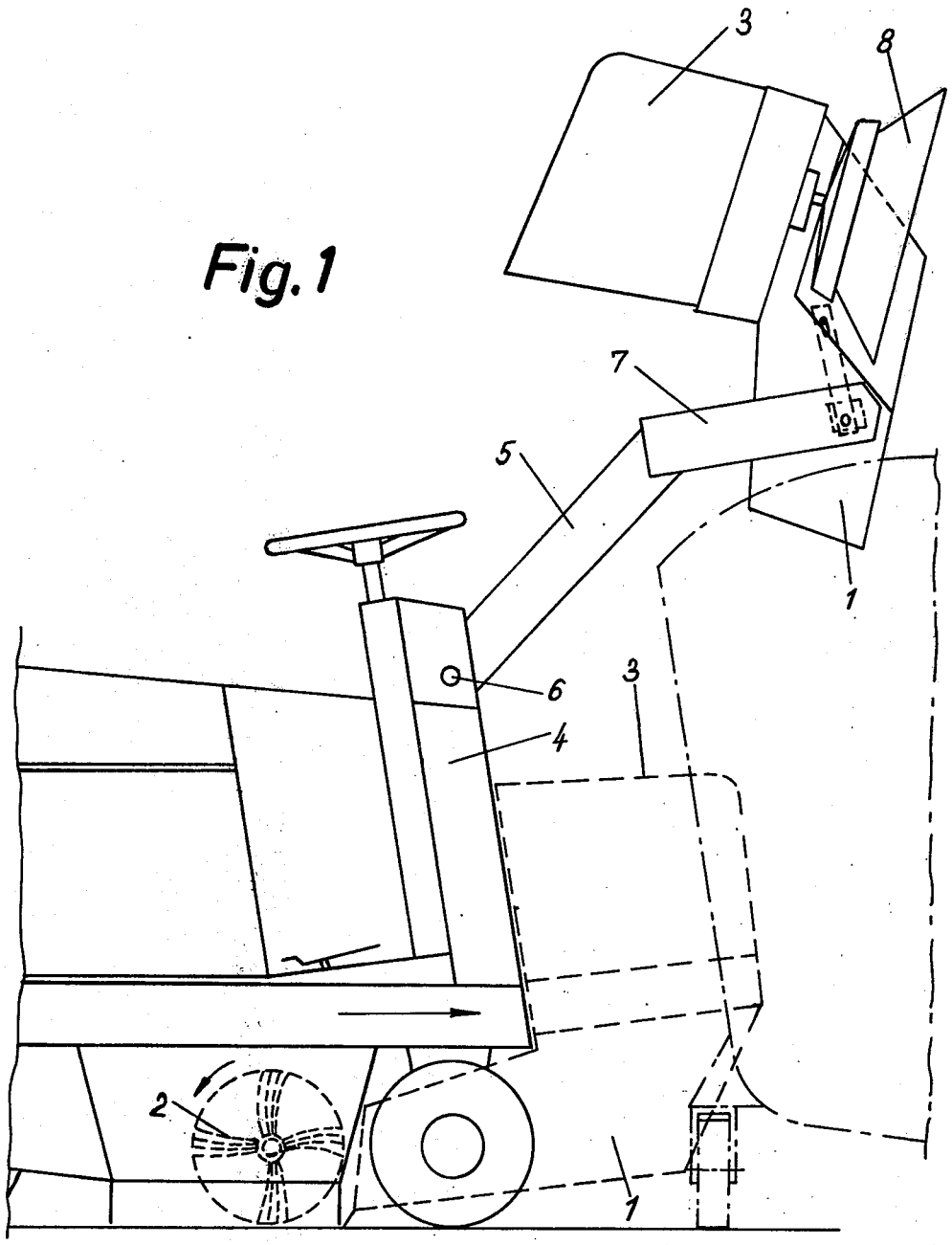
FIG. 1 is a side-view of a suction-assisted mechanical sweeper according to the invention with its rubbish hopper raised above a rubbish skip shown in chain lines.
Figure 4:
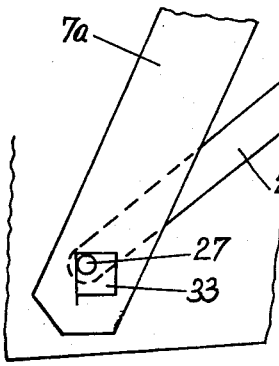
FIG. 4 is a partial view along the IV—IV of FIG. 3.
Figure 3:
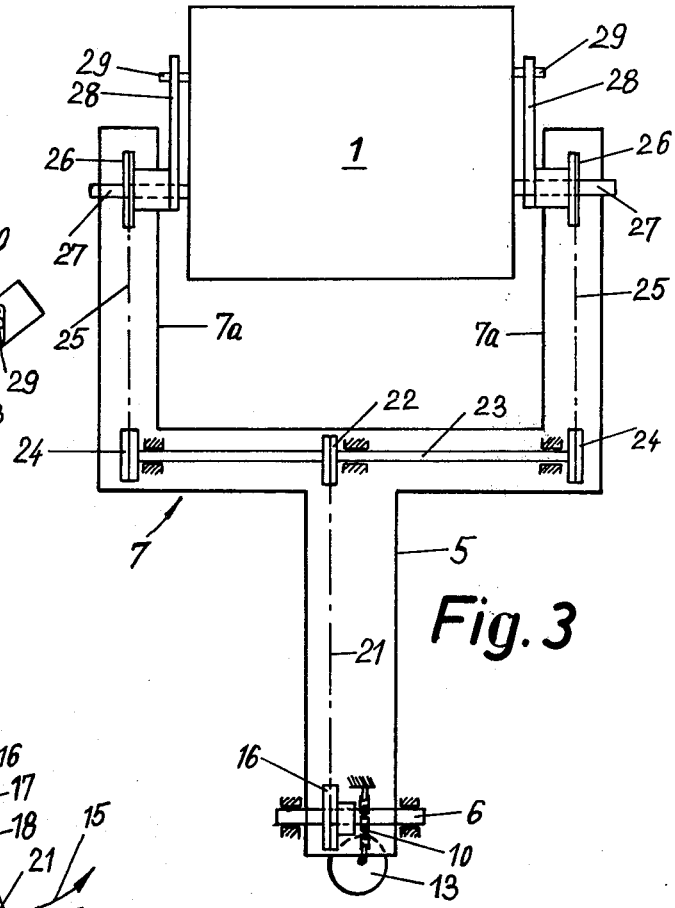
FIG. 3 is a general view of the chain linkage for lifting the hopper.
Figure 2:
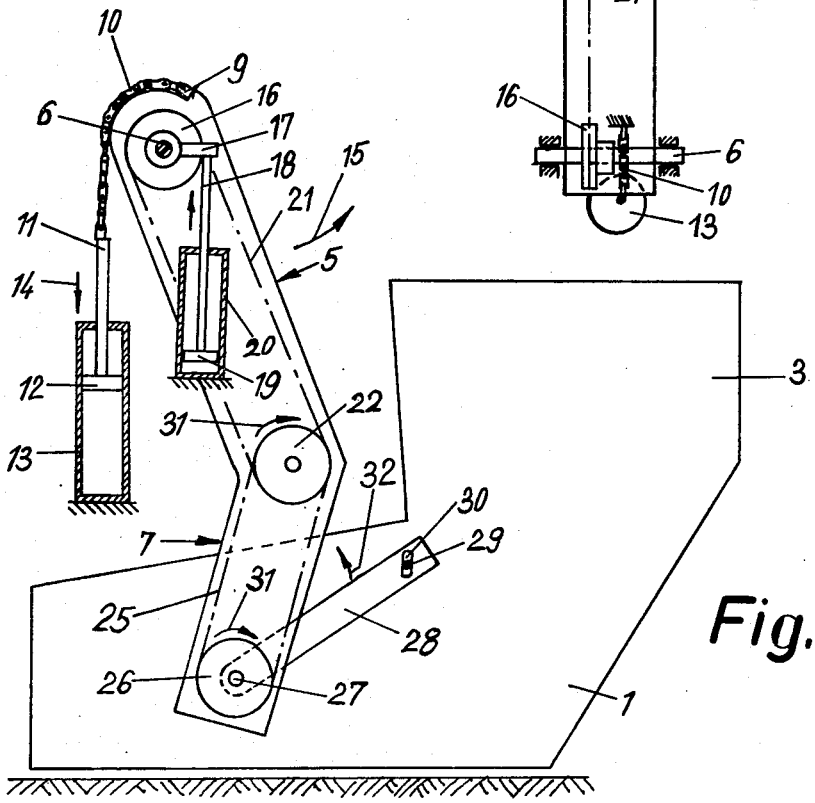
FIG. 2 shows the principle on which the rubbish hopper is lifted out of the sweeper.

In the case of the embodiment shown in the drawings, what is involved is a driver-carrying suction-assisted mechanical sweeper having a roller brush 2 which throws rubbish forward into a hopper 1 at the front. The rubbish hopper has connected to it a structure 3 containing a dust filter, which when the hopper is in its collecting position (shown in broken lines) is connected upstream of the filter to a suction duct which leads to the sweeper's suction fan.

In the upper end of a support frame 4 fixed to the sweeper is mounted a lifting arm 5 which is able to be pivoted forwardly and upwardly about a shaft 6. This arm is rigidly joined to a fork 7, in which the rubbish hopper 1, the structure 3 associated with it, and a lateral brush 8 are mounted in a manner which will be described below in detail.

In accordance with the invention, to allow the pivoting movement of the lifting arm 5 and the fork 7 to take place, a flexible elongated member 10 such as a chain or cable or the like passes around a rounded upper surface and engages with the upper side of the arm 5 at 9. This chain 10 passes around the rounded or part-circular upper end of arm 5 and at its other end engages with a rod 11 secured to a piston 12. The piston 12 can be moved hydraulically in either direction in a cylinder 13 as part of a second actuator which is fixed in the support frame 4. When piston 12 is moved in the direction of arrow 14, the chain 10 is drawn in. When it is drawn in, it carries the lifting arm 5 with it, the arm being pivoted in this way about shaft 6 in the direction of arrow 15 and thus raising the rubbish hopper 1 and its structure 3 to any desired height. In accordance with invention, the rubbish hopper 1 will maintain its position parallel to the ground while the lifting arm 5 is performing its pivoting movement, a sprocket 16 is mounted to rotate freely on shaft 6, although during the pivoting movement of the lifting arm it is held stationary so as not to rotate, which is done by connecting its hub rigidly to a lever 17 to whose end a rod 18 secured to a piston 19 is articulated. Piston 19 can be moved hydraulically in both directions in a cylinder 20 as part of a second actuator which is hinged to the support frame 4 and the starting position of piston 19 is at its lowermost position, at which it remains during the pivoting movement of the lifting arm.

A chain 21 runs around sprocket 16 and this chain runs around a sprocket 22 associated with arm 5 at the end of the arm. Sprocket 22 is mounted on a shaft 23 which has further sprockets 24 secured to its ends at the points where the arms 7*a* of the fork are situated. Chains 25 run around each of the sprockets 24 and in the ends of the arms 7*a* of the fork they pass around hopper sprockets 26, which are mounted on stub-shafts 27 rigidly connected to the side-walls of the rubbish hopper 1 in such a way as to be free to rotate thereon. At points clear of the arms 7*a*, the hubs of the sprockets 26 have levers 28 connected to them and these levers have in their free ends elongated holes 30 through which project pins 29 connected to the side-wall of the rubbish hopper 1.

When it is necessary for the full rubbish hopper 1 to be emptied, the lifting arm 5, 7 is pivoted in the direction of arrow 15 by means of a traction exerted hydraulically on chain 10. While this takes place, sprocket 16 is held stationary, with the result that chain 21 lifts away from the upper part of sprocket 16 and engages with further teeth around its bottom part, and sprockets 22, 24 and 26 thus turn in the direction of arrow 31. At the same time this causes levers 28 to pivot with respect to the arms 7*a* of the fork and because of the pins 29 connecting them to the rubbish hopper 1 the levers 28 hold the hopper parallel to the ground at all times until the desired vertical position, e.g. above the rubbish skip shown in chain lines in FIG. 1, is reached. The piston 19 in the second cylinder 20 is now made to move upwards by a control means and as a result sprocket 16 is turned, by which means chains 21 and 25 turn sprockets 22 and 26 in the opposite direction from arrow 31. This causes levers 28 to be pivoted in the direction of arrow 32 and causes them to tip the rubbish hopper 1 on stub-shafts 27 until its open side is downwards so that its contents are emptied into the rubbish skip.

It is of course also possible in accordance with the invention to replace the hydraulic actuators by motorised actuators.

During the sweeping operation the rubbish hopper has its open bottom edge near the ground and to ensure that it can ride up when it encounters bulky rubbish such as bottles or the like, the arms 7*a* of the fork are provided with fairly large openings 33, e.g. square or rectangular openings, through which stub-shafts 27 freely project. In normal operation the stub-shafts rest against the top edge of openings 33. The rubbish hopper 1 can now ride up or swing free when it encounters large objects to the extent allowed by the openings 33.

What we claim is:

1. In a mechanical sweeper comprising a roller brush arranged to throw rubbish forwardly of the sweeper, a hopper mounted on the sweeper to receive rubbish from the roller brush, suction means, and a filter interposed between the hopper and the suction means, the improvement comprising: a support frame mounted on the sweeper; a lifting arm pivotably mounted at one end thereof to the upper end of said support frame; a fork carried at the other end of the lifting arm, the fork pivotably mounting said hopper; arm-pivoting and hopper-tilting means mounted on the support frame, the lifting arm and the fork, for pivoting said lifting arm to thereby raise said hopper and maintain said hopper in an upright state during sweeping and lifting respectively, and for tilting the hopper from the upright state to thereby empty the hopper after the lifting arm has been raised to a predetermined pivoted position.

2. In a mechanical sweeper comprising a roller brush arranged to throw rubbish forwardly of the sweeper, a hopper to receive rubbish from the brush mounted on lifting means pivotably mounted on the upper front end of the sweeper to pivotably move the hopper up and down for emptying same in a raised position, suction means, and a filter interposed between said hopper and said suction means, the improvement consisting in that the lifting means comprises a lifting arm pivotably mounted at one end to a support frame on said sweeper, a fork carried at the other end of said lifting arm, the fork pivotably mounting said hopper, and a first actuator means for pivotably moving said lifting arm, and the improvement further consisting of hopper-tilting means (1) for holding the bottom of said hopper parallel to the ground when the hopper is in a rubbish-receiving position during sweeping, and during the lifting of the hopper to a pivoted position for dumping, and (2) for tilting said hopper thereby to empty the hopper when said lifting arm is in any pivoted position.

3. A mechanical sweeper according to claim 2, wherein the lifting arm is pivotably mounted at said one end on a shaft at the upper end of said support frame, said first actuator means of said lifting means comprising a chain with one end secured to and passing around a rounded upper surface of said one end of said lifting arm and with the other end secured to an actuator, for lifting and for lowering said lifting arm by means of the actuator drawing in and letting out said chain, to thereby pivotably move the lifting arm about said shaft, and wherein said hopper tilting means comprises a first sprocket mounted freely rotatably on said shaft, second actuator means mounted on said support frame and operative alternatively to hold said first sprocket stationary and to turn the sprocket, a further chain passing around said first sprocket and an intermediate sprocket fixedly mounted on a second shaft rotatably mounted on said other end of said lifting arm, said second shaft having a further sprocket mounted on each end thereof, a hopper sprocket rotatably mounted on a distal end of each arm of said fork, a side chain mounted around a further sprocket and a hopper sprocket in each of said arms, the hopper sprockets being mounted freely rotatably on stub-shafts outwardly extending from the side-walls of said hopper, each hopper sprocket having a lever rigidly connected at one end thereto, the other end of each lever operatively acting with a pin fastened to a side-wall of said hopper, whereby the bottom of said hopper can be held parallel to the ground in any position of said lifting arm when said second actuator means is being held stationary and whereby at any lifted position of said arm the hopper can be tipped for emptying when said second actuator is operated.

4. A mechanical sweeper according to claim 3, wherein the arms of said fork have fairly large openings for receiving said stub-shafts of said hopper whereby said hopper, when it is in the operating position, can swing free up and down with said stub-shafts in the openings so as to override bulky rubbish.

5. A mechanical sweeper according to claim 4, wherein said actuator for drawing in and letting out said chain is a hydraulic piston-cylinder-arrangement whose piston has a rod connected to one end of said chain.

6. A mechanical sweeper according to claim 4, wherein said second actuator means comprises a lever arm connecting said first sprocket to the rod of a further hydraulic piston-cylinder-arrangement.

* * * * *